US008381775B2

(12) United States Patent
Healy

(10) Patent No.: US 8,381,775 B2
(45) Date of Patent: Feb. 26, 2013

(54) VAPOR CONTAINMENT

(76) Inventor: James W. Healy, Hollis, NH (US)

( * ) Notice: Subject to any disclaimer, the term of this patent is extended or adjusted under 35 U.S.C. 154(b) by 860 days.

(21) Appl. No.: 11/744,541

(22) Filed: May 4, 2007

(65) Prior Publication Data

US 2008/0271811 A1 Nov. 6, 2008

(51) Int. Cl.
*B65B 31/00* (2006.01)

(52) U.S. Cl. ..... 141/4; 141/44; 141/114; 141/290; 141/313

(58) Field of Classification Search ..... 141/2, 4, 141/18, 37, 44, 45, 59, 98, 114, 285, 290, 141/313; 137/587
See application file for complete search history.

(56) References Cited

U.S. PATENT DOCUMENTS

| | | | | |
|---|---|---|---|---|
| 3,614,960 | A * | 10/1971 | Pfrengle | 137/43 |
| 3,926,230 | A | 12/1975 | Stary et al. | |
| 4,009,739 | A | 3/1977 | Weatherford | |
| 4,057,085 | A | 11/1977 | Shihabi | |
| 4,131,141 | A | 12/1978 | Weissenbach | |
| 4,223,706 | A | 9/1980 | McGahey | |
| 4,380,909 | A | 4/1983 | Sung | |
| 4,763,805 | A | 8/1988 | Strock | |
| 5,305,807 | A | 4/1994 | Healy | |
| 5,367,882 | A | 11/1994 | Lievens et al. | |
| 5,411,374 | A | 5/1995 | Gram | |
| 5,537,911 | A | 7/1996 | Ohlrogge et al. | |
| 5,803,136 | A | 9/1998 | Hartsell, Jr. | |
| 5,878,790 | A | 3/1999 | Janssen | |
| 6,039,123 | A | 3/2000 | Webb | |
| 6,128,908 | A | 10/2000 | Gustafson | |
| 6,478,849 | B1 | 11/2002 | Taylor et al. | |
| 6,763,856 | B2 | 7/2004 | Healy | |
| 6,805,173 | B2 | 10/2004 | Healy | |
| 7,028,675 | B2 | 4/2006 | Bushnell et al. | |
| 2009/0007983 | A1 | 1/2009 | Healy | |

FOREIGN PATENT DOCUMENTS

| | | |
|---|---|---|
| DE | 196 06 181 | 8/1997 |
| DE | 198 29 805 | 2/2000 |
| EP | 0 514 993 | 11/1992 |
| EP | 0 985 634 | 3/2000 |
| FR | 2 317 126 | 2/1977 |

OTHER PUBLICATIONS

International Search Report; PCT/US03/18069; Sep. 18, 2003; C. Muller.
International Search Report; PCT/US03/00906; May 13, 2003; M. Desittere.

(Continued)

*Primary Examiner* — Gregory Huson
*Assistant Examiner* — Jason K Niesz
(74) *Attorney, Agent, or Firm* — Fish & Richardson P.C.

(57) ABSTRACT

A passive method for conserving fuel vapor by connecting the ullage space of the liquid fuel storage tanks to a bladder in a vapor conservation tank; connecting the ullage space of a liquid fuel delivery vehicle to air space of the vapor conservation tank, external of the bladder; delivering liquid fuel from the delivery vehicle into the liquid fuel storage tanks, the liquid fuel displacing fuel vapor from the storage tanks; delivering displaced fuel vapor into the bladder, the delivered fuel vapor inflating the bladder and displacing air from the air space of the vapor conservation tank, external of the bladder; and, thereafter, over time, delivering fuel vapor from the bladder into ullage space of the fuel storage tanks, replacing the volume of liquid fuel delivered from the fuel storage tanks into vehicle fuel tanks. A passive system for conserving fuel vapor is also described.

12 Claims, 9 Drawing Sheets

OTHER PUBLICATIONS
International Search Report; PCT/US08/61943; Apr. 30, 2008; Lee W. Young; Aug. 29, 2008.
International Search Report and Written Opinion of the International Search Authority; PCT/US2009/053344; B.R. Copenheaver; Oct. 1, 2009.
International Preliminary Report on Patentability; PCT/US2009/05334; Athina Nickitas-Etienne; Feb. 15, 2011.
Supplementary European Search Report (EP Appl. No. 08 76 7942); Jan. 12, 2012 (3 pages).

* cited by examiner

VAPOR CONTAINMENT

TECHNICAL FIELD

This disclosure relates to underground fuel storage tanks, and more particularly to systems for containment and conservation of fuel vapor from such tanks.

BACKGROUND

Vehicle fueling service stations in some regions of the United States, i.e. those regions where only Phase I (i.e. non-Phase II) vapor recovery is mandated, and in many other countries, operate with limited or no restrictions on release of fuel vapors into the environment, e.g. including fuel vapors generated by evaporation of liquid fuel into the ullage space of vehicle and underground storage tanks ("UST"), and then displaced from the tank by entering liquid fuel during filling. This loss of fuel in its vapor state is recognized as a detriment to the environment. Over a period of fueling operations, it can also represent a substantial loss of product and potential profit to the service station owner and operator.

SUMMARY

According to one aspect of the disclosure, a method of conserving fuel vapor in a liquid fuel dispensing system comprising one or more liquid fuel storage tanks connected to a dispenser for delivering liquid fuel to vehicle fuel tanks, a volume of liquid fuel dispensed from the one or more liquid fuel storage tanks being replaced by a volume of air, comprises: connecting ullage space of the one or more liquid fuel storage tanks to a bladder within a vapor conservation tank; delivering liquid fuel into the one or more liquid fuel storage tanks, the liquid fuel displacing fuel vapor from the one or more liquid fuel storage tanks; delivering displaced fuel vapor into the bladder, the delivered fuel vapor inflating the bladder and displacing air from the air space of the vapor conservation tank external of the bladder; and, thereafter, over time, delivering fuel vapor from the bladder of the vapor conservation tank into ullage space of the one or more liquid fuel storage tanks, replacing the volume of liquid fuel delivered from the one or more liquid fuel storage tanks into vehicle fuel tanks.

Preferred implementations of this aspect of the disclosure may include one or more of the following additional features. The method comprises delivering liquid fuel from a liquid fuel delivery vehicle, e.g. a tanker truck or rail car, into the one or more liquid fuel storage tanks. The method further comprises connecting ullage space of the liquid fuel delivery vehicle to air space of the vapor conservation tank containing the bladder, external of the bladder; and delivering the air displaced from the air space of the vapor conservation tank into the ullage space of the liquid fuel delivery vehicle, the displaced air replacing a volume of the liquid fuel delivered from the liquid fuel delivery vehicle. The method further comprises delivering the air displaced from the air space of the vapor conservation tank into the ambient environment. The method comprises the further step of connecting one or more underground storage tanks to a vapor conservation tank in the form of an auxiliary tank containing the bladder. The method comprises the further step of connecting one or more underground storage tanks to a vapor conservation tank in the form of an aboveground auxiliary tank containing the bladder. The method comprises the further steps of converting an underground storage tank to a vapor conservation tank containing the bladder, and connecting one or more underground storage tanks to the vapor conservation tank in the form of the converted underground storage tank containing the bladder.

According to another aspect of the invention, a fuel vapor conservation system comprises: a liquid fuel dispensing system comprising one or more liquid fuel storage tanks connected to a liquid fuel dispenser for delivering liquid fuel to vehicle fuel tanks, the one or more fuel storage tanks defining ullage space containing evaporated fuel vapor above an interface with liquid fuel; a vapor conservation system comprising a tank defining a tank volume, and a bladder disposed within the tank volume and defining a bladder volume for receiving fuel vapor, the tank and the bladder defining an air space external of the bladder; a system of vapor conduit for conducting fuel vapor between the ullage space and the bladder volume; and a system of air conduit for conducting air into and out of the air space external of the bladder.

Preferred implementations of this aspect of the disclosure may include one or more of the following additional features. The system of vapor conduit further comprises a conduit system for delivery of fuel vapor displaced from the ullage space by addition of liquid fuel to the one or more fuel storage tanks into the bladder volume, and for delivery of fuel vapor from the bladder volume back into the ullage space as liquid fuel is dispensed from the one or more liquid fuel storage tanks. The system of vapor conduit further comprises a conduit system for delivery of fuel vapor from the bladder volume back into the ullage space as liquid fuel is dispensed from the one or more liquid fuel storage tanks into vehicle fuel tanks over time. The system of vapor conduit further comprises a float check valve for restricting flow of liquid fuel toward the bladder volume. The system of air conduit further comprises a conduit system for delivery of the air displaced from the air space of the vapor conservation tank into the ullage space of a liquid fuel delivery vehicle, e.g. a liquid fuel delivery tanker truck or tanker rail car, replacing a volume of liquid fuel delivered from the liquid fuel delivery vehicle. The system of air conduit further comprises a conduit system for delivery of the air displaced from the air space of the vapor conservation tank into the ambient environment. The bladder is inflatable and collapsible. The bladder is formed of thin wall, flexible material. The bladder is formed of resilient material.

Objects of this disclosure include providing a system for containment and recovery of fuel vapors, e.g. in regions of the United States with only Phase I vapor recovery mandates, and in similarly lightly regulated and non-regulated foreign countries.

Unless otherwise defined, all technical and scientific terms used herein have the same meaning as commonly understood by one of ordinary skill in the art to which this disclosure belongs. Although methods and materials similar or equivalent to those described herein can be used in the practice or testing of the present disclosure, suitable methods and materials are described below. All publications, patent applications, patents, and other references mentioned herein are incorporated by reference in their entirety. In case of conflict, the present specification will control. In addition, the materials, methods, and examples are illustrative only and not intended to be limiting. Other features and advantages will be apparent from the following detailed description, and/or from the claims.

DESCRIPTION OF DRAWINGS

Like reference symbols in the various drawings indicate like elements.

DETAILED DESCRIPTION

Figure 1:
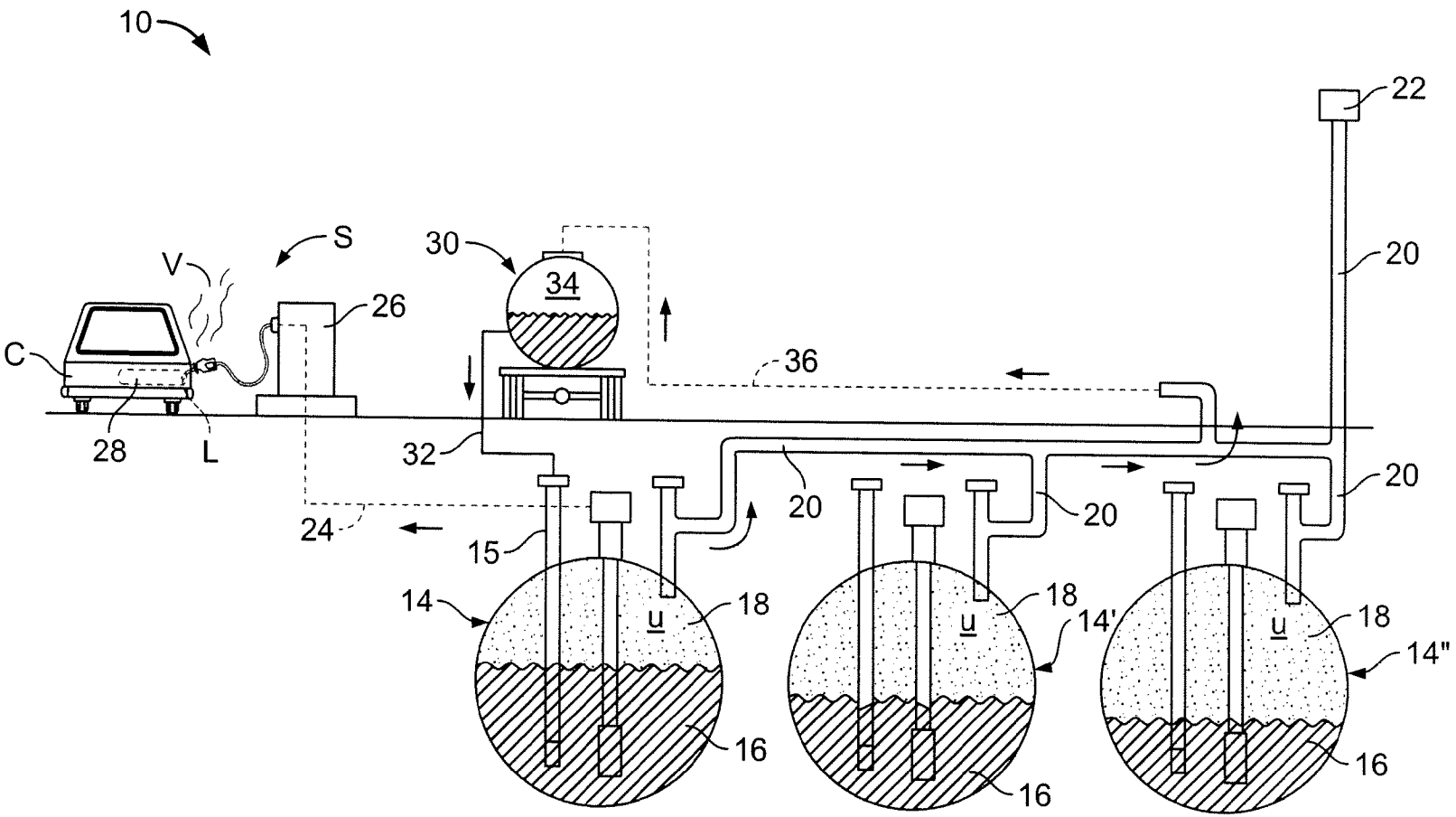
FIG. 1 (Prior Art)
FIG. 1 is a somewhat diagrammatic representation of a typical (prior art) gasoline service station during a fuel "drop" or delivery, e.g. in the United States where only Phase I (i.e. non-Phase II) vapor recovery is mandated, and in other countries.

Referring to FIG. 1, in a typical prior art fuel storage and delivery system 10, e.g. at a gasoline fueling station, S, each underground storage tank ("UST") 14 contains a volume of volatile liquid fuel 16, e.g. gasoline, and a volume of a saturated or semi-saturated mixture of gaseous fuel vapor and/or air 18 in a vapor or ullage space, U, above the liquid fuel. The ullage space is connected to the atmosphere via conduit 20, controlled by a UST pressure/vacuum relief vent valve 22, which typically is set to open at −8.0 inches W.C. to permit intake of air into the ullage space and to open at +3.0 inches W.C. to permit release of gaseous vapor from the ullage space, thereby to avoid dangerous buildup of pressure or vacuum within the UST 14.

During refueling of a vehicle, C, as liquid fuel, L, is delivered via conduit 24 from the UST 14 into the vehicle tank 28, fuel vapor, V, displaced from the vehicle tank by the liquid fuel is permitted to escape into the environment.

Bulk liquid fuel is delivered to service station, S, by fuel delivery vehicle, e.g. tanker truck 30. During a fuel "drop" or delivery, the truck tank is connected by conduit 32 to the fuel inlet spout 15 of UST 14, while the ullage space 18 of UST 14 is connected by conduit 36 to the ullage space 34 of the tanker truck. Delivery of liquid fuel 16 into UST 14, e.g. about 5,000 gallons delivered at 400 GPM (gallons per minute) is typical, causes displacement of fuel vapor 18 from the ullage of space, U, of UST 14, into the ullage space 34 of the tank truck, replacing the liquid fuel as it is delivered. Upon completion of the fuel drop, the tanker truck departs carrying 5,000 gallons of fuel vapor created from gasoline previously purchased by the service station owner, with the fuel vapor being subsequently displaced back into fuel company tanks as the tanker truck is filled for its next delivery.

Figure 2:
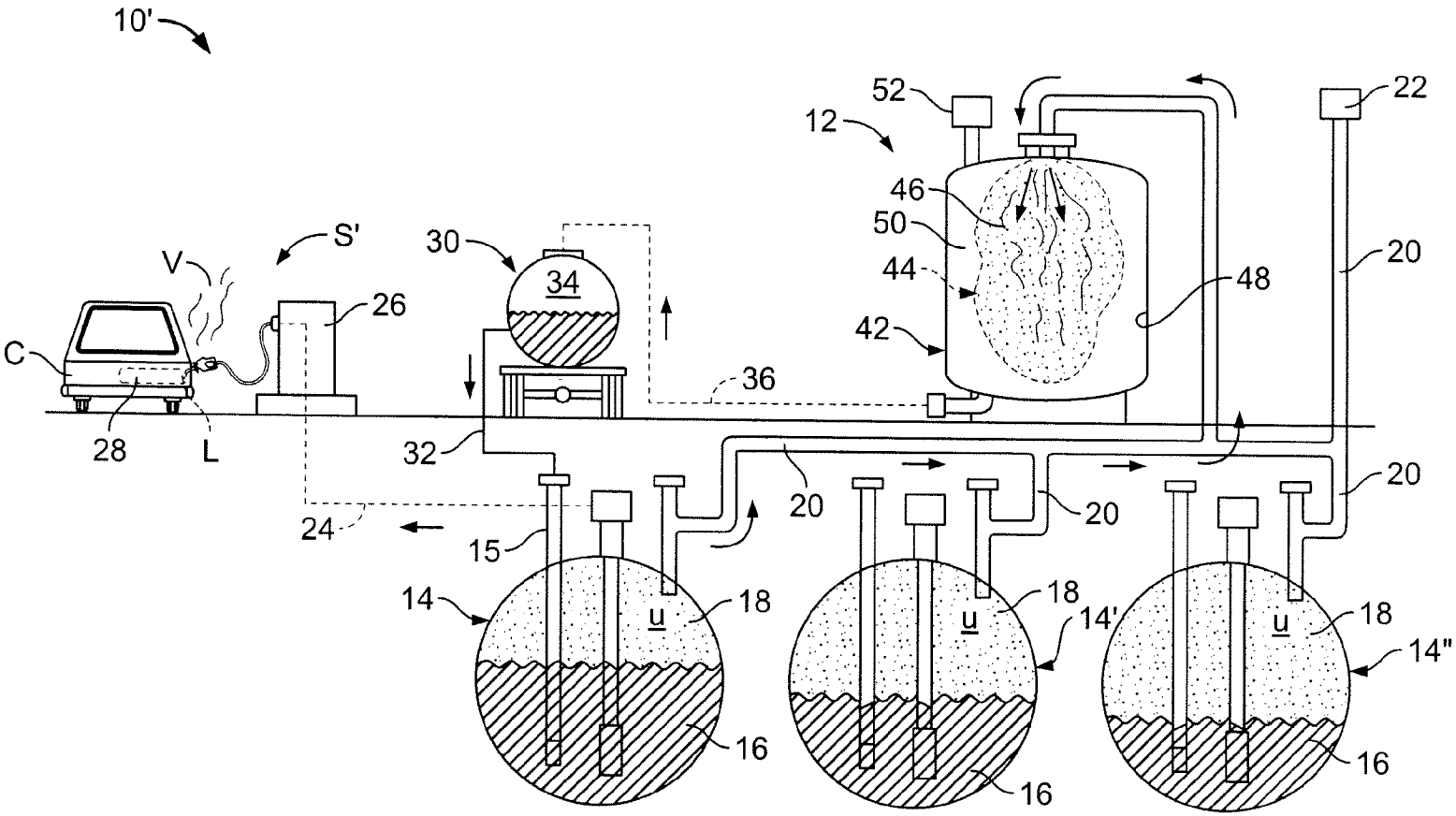
FIG. 2 is a somewhat diagrammatic representation of a Phase I gasoline service station of the type depicted in FIG. 1 during a fuel drop, the service station being equipped with one implementation of a fuel vapor containment system of the disclosure, the vapor containment tank being aboveground.

Referring now to FIG. 2, according to the present disclosure, the fuel storage and delivery system 10', e.g. at a gasoline fueling station, S', is further equipped with vapor containment system 12 of the disclosure for capturing and retaining fuel, e.g. gasoline vapors at a service station, e.g. rather than transferring the vapors for removal in a fuel tanker truck, as typically occurs at service stations with Phase I only vapor recovery, and/or rather than releasing all or a portion of those fuel vapors into the environment.

The vapor containment system 12 includes a vapor storage tank 42, e.g. an 8,000 gallon steel storage tank, connected to conduit 20, which, in turn, is in communication with the vapor space, U, of UST 14. The vapor space is controlled by pressure/vacuum relief vent valve 22, as described above. The storage tank 42 contains a thin wall, resilient, flexible urethane, inflatable bladder 44 defining an auxiliary vapor space volume 46 within the bladder, which is in communication with the UST vapor space, U, via conduit 20. The bladder 44 and the storage tank wall 48 also together define an air space 50 within the vapor storage tank 42 but external of the bladder 44, which is in communication with the atmosphere through a 1-inch orifice air relief/air ingestion port 52 to release air from the air space 50, and also to ingest air into the air space 50 at about 20 GPM when the pressure differential is 1 inch W.C., as described in more detail below. This is a passive system not requiring electrical components. As a result, installation costs are relatively low.

Figure 3:
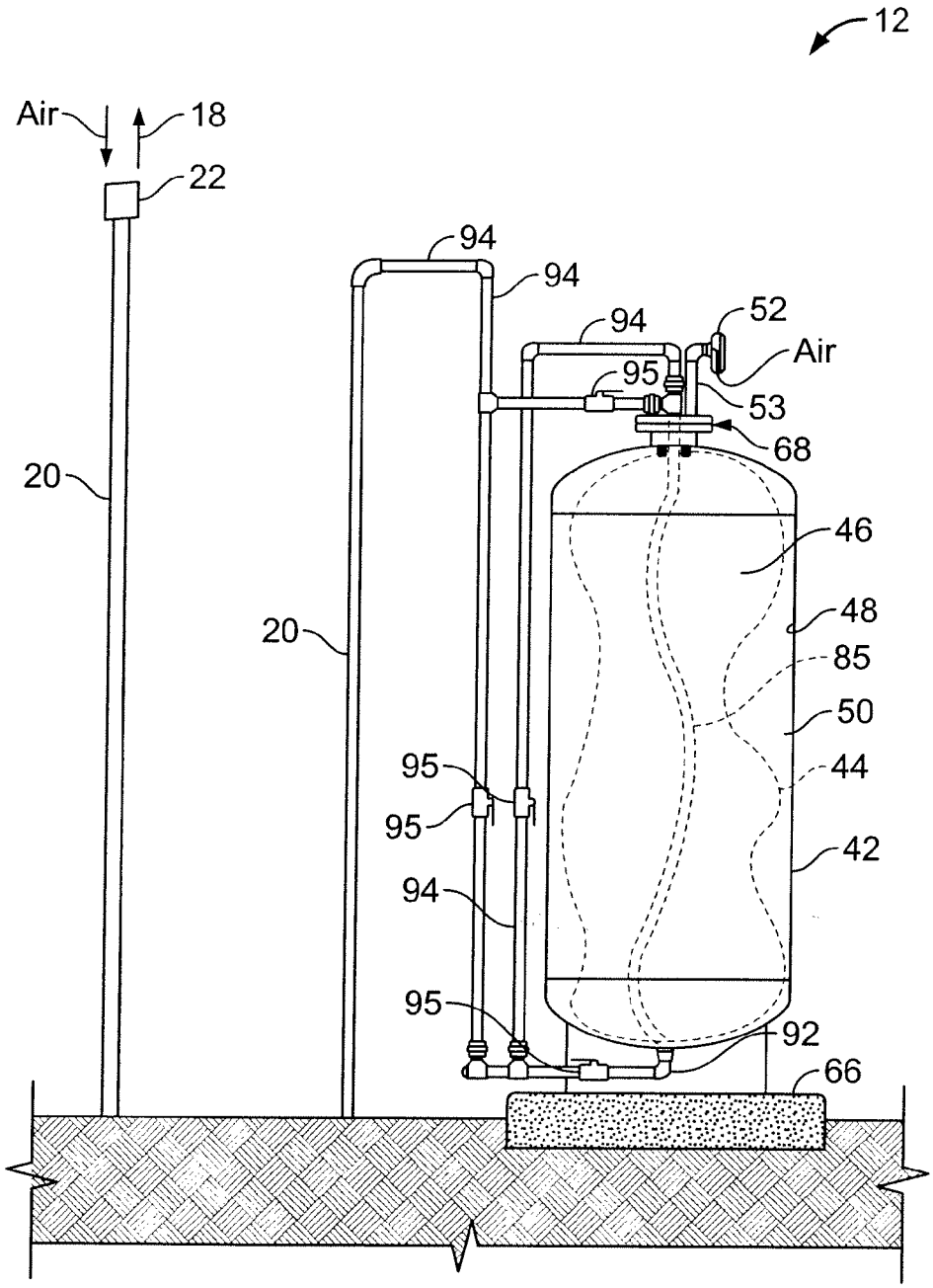
FIG. 3 is a somewhat diagrammatic side section view of a slightly different implementation of the fuel vapor containment system of FIG. 2 with an aboveground vapor containment tank.
Figure 4:
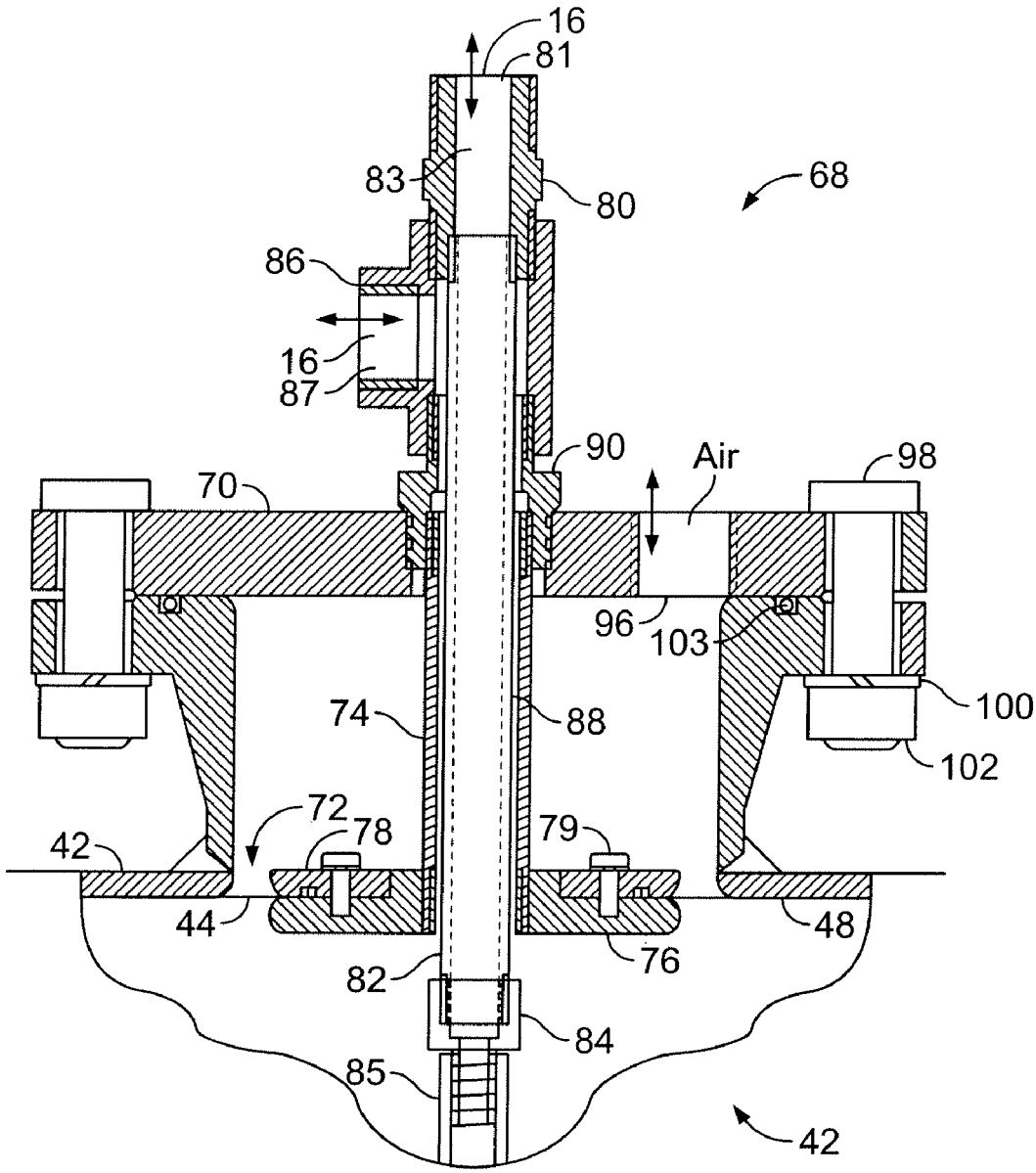
FIG. 4 is a somewhat diagrammatic enlarged side section view of the bladder support assembly for the fuel vapor containment system of FIG. 3.

Referring also to FIGS. 3 and 4, and also to my U.S. Patent No. 6,805,173, the complete disclosure of which is incorporated herein by reference, the vapor storage tank 42 is shown mounted in vertical position, e.g. upon a concrete tank slab 66 (other suitable methods for installation and mounting may be employed). The bladder 44 is suspended within the air space volume 50 of the tank 42 from the bladder support assembly 68. The support assembly includes a flange 70, secured to neck 71 at an aperture 72 into the tank volume by bolts 98 with lock washers 100 and nuts 102, sealed by o-rings 103, from which extends a pipe nipple 74 supporting a circumferential bladder flange 76. A clamp ring 78 bolted (79) to the bladder flange secures and seals the bladder opening. A tap 80 defines an inlet/outlet 81 to a first, axial vapor passageway 83 into the bladder volume 46 by way of pipe nipple 82 terminating in a pipe barb 84 and a siphon tube 85 that extends to the lower end of the bladder 44 within the tank 42. A tee-fitting 86 (to which tap 80 is mounted) defines an inlet/outlet 87 to a second, annular passageway 88 through the space between coupling 90 and pipe nipple 74 and the outer wall of pipe nipple 82. The inlets/outlets 81, 87, as well as condensate drain 92 from the base of the tank air space 50, are connected to conduit 20 by 1-inch connection piping 94. Flow through the connection piping 94 is controlled by ball valves 95, which should be padlock-secured against tampering. The air relief/air ingestion port 52 is connected to a pipe nipple 53 (FIG. 3) mounted to the flange 70 at an aperture 96 in communication with the air space 50 about the bladder 44 in tank 42.

In FIGS. 1 and 2, as described above, all three USTs 14 are employed for storage of liquid fuel, traditionally with the USTs 14, 14' and 14" respectively dedicated to storage of regular grade fuel, middle or mid grade fuel, and premium or plus grade fuel.

Figure 5:
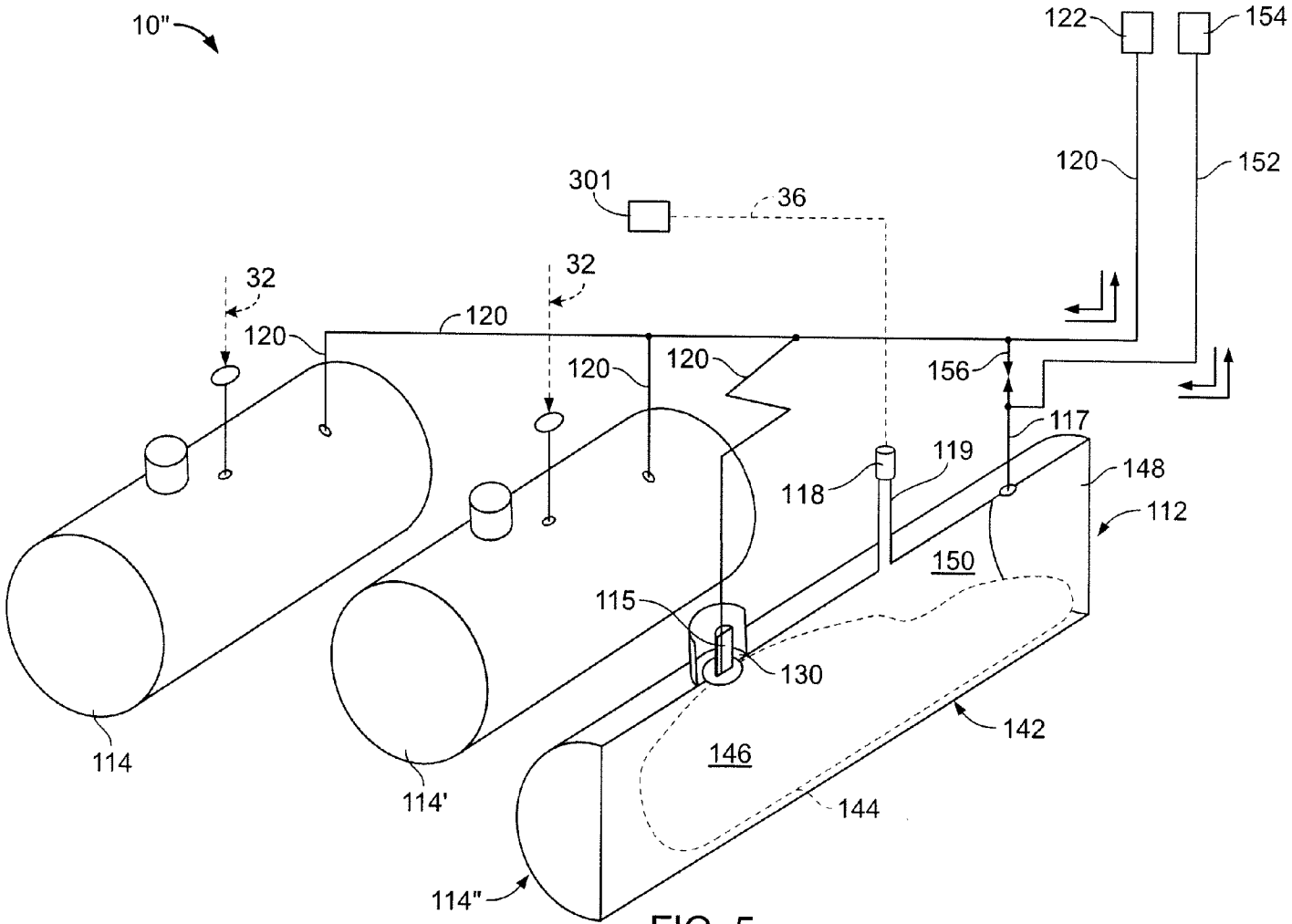
FIG. 5 is a somewhat diagrammatic representation of another implementation of a gasoline vapor containment system of the disclosure, the fuel vapor containment tank being underground.

Referring also now to FIG. 5, in another, generally more preferred implementation, fuel storage and delivery system 10" is upgraded for use with a Uni-hose dispenser system (not shown) that permits blending of regular grade fuel with premium or plus grade fuel from USTs 114 and 114' to provide a blended middle or mid grade fuel at the dispenser 26 (FIGS. 1 and 2). As a result, the third UST 114" is no longer utilized for storage of liquid fuel, making it available for use as a vapor storage tank 142 in a vapor containment system 112. The existing third tank, previously used to hold the mid-grade fuel product, is converted into a fuel vapor containment tank 142, in a vapor containment system 112, with an inflatable/collapsible bladder 144 for capturing and containing fuel vapor disposed within the underground tank. This alternative implementation typically provides relatively better economics, since it makes unnecessary installation of an additional aboveground tank and piping, e.g. as described with respect to FIG. 2.

According to this implementation, the third UST 114" is retrofitted (typically after removal of the submerged turbine fuel pump (not shown) to provide maximum available volume) by installation of an inflatable/collapsible bladder 144, e.g., formed of thin wall, resilient, flexible material, e.g. urethane, defining an auxiliary vapor space volume 146 through the tank hatchway 130 (FIG. 5). The fuel vapor piping 120 is modified to place the ullage spaces, U, of USTs 114 and 114' in communication with the auxiliary vapor space volume 146 of the bladder 144, e.g. via the former liquid fuel submerged turbine port pipe 115. The fuel vapor outlet pipe 117 from tank 114", now in communication with the air space 150 defined between the bladder 144 and the storage tank wall 148, is placed in communication with the atmosphere through conduit 152, terminating at an air relief/air ingestion assembly 154, having a 1-inch orifice, again as described in more detail below. The piping connection between tank 114" and the fuel vapor piping 120 is secured by valve 156, which is closed during normal operation. As in the implementation described above, this is a passive system not requiring electrical components. As a result, retrofitting and installation costs are relatively low.

Figure 6:
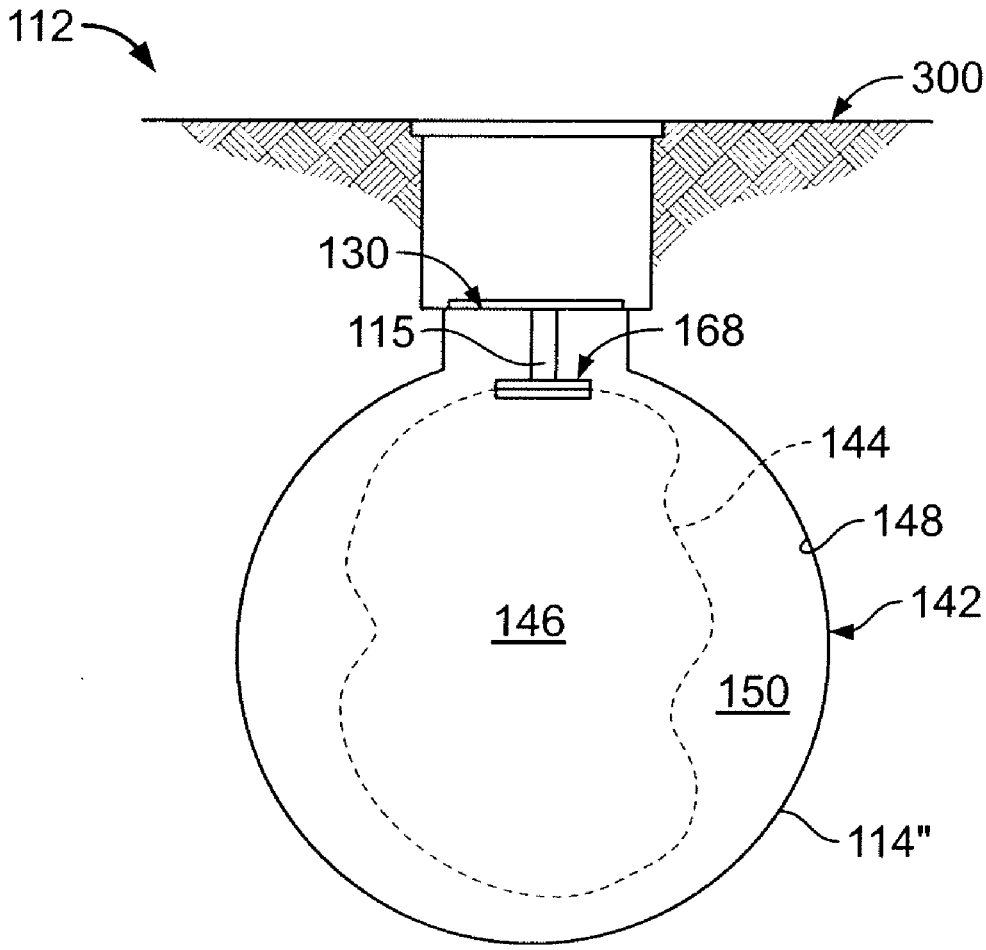
FIG. 6 is an end view of the underground fuel vapor containment tank of FIG. 5.

Referring also to FIG. 6, and with reference to the above description of FIGS. 3 and 4, the bladder 144 is suspended within the air space volume 150 of the tank 142 from the bladder support assembly 168, through which extends former liquid fuel submerged turbine port 115, now connected to vapor conduit 120.

Referring again to FIG. 2, and more particularly to FIG. 7, in operation of the vapor containment system 112 of the disclosure, a fuel drop or delivery at a service station, S', with conservation of fuel vapor by the fuel station operator or owner, proceeds as follows:

1. With the bladder 144 in a collapsed condition, the driver of fuel tanker truck 30 makes a fuel hose connection (typically a 4-inch diameter hose 32) between the underground storage tank 114 and the tanker truck 30.

2. The driver makes a vapor hose connection (typically a 3-inch diameter hose 36) to pipe 119 in communication with the air space 150 of the vapor containment tank 114", external of the bladder 144.

3. The driver opens the tanker vapor valve 301.

4. The driver opens the tanker liquid fuel valve 302.

5. The tanker truck 30 drops 5,000 gallons of liquid fuel 16 through conduit 32 and pipe inlet 15, into the UST 114, at a rate of up to 400 GPM, forcing 5,000 gallons of vapor 18 from the ullage space, U, of UST 114, through vapor conduit 120 and pipe inlet/outlet 115, into the auxiliary vapor space volume 146 of the bladder 144.

6. Inflation of the bladder 144 forces 5,000 gallons of air from the air space 150 between the bladder 144 and the wall 148 of UST 114" through pipe inlet/outlet 119 and conduit 36, into the tanker 30.

7. The tanker 30 disconnects and leaves, carrying 5,000 gallons of air.

8. Vehicles, C, are fueled with the 5,000 gallons of liquid fuel 16 delivered into UST 114, with removal of liquid fuel 16 from UST 114 drawing vapor 18 from the auxiliary vapor space volume 146 of bladder 144 into the ullage space, U, of UST 114.

9. Removal of vapor 18 from the bladder 144 into the ullage space, U, of UST 114" causes gradual collapse of bladder, drawing air through conduit 152 and pipe 117, into the air space region 150 between the bladder 144 and the wall 148 of the UST 114".

10. The entire process is repeated with each subsequent bulk delivery of liquid fuel 16.

Delivery of liquid fuel, e.g. gasoline, from the fuel tanker truck 30, at flow rates up to 400 GPM, into the underground storage tank 114 forces the fuel vapor 18 in the ullage space, U, of the underground storage tank 114 to flow through conduit 120, e.g. an underground 2-inch pipe, to inflate the bladder 144 in the vapor containment tank, i.e. aboveground tank 42 (FIG. 2) or underground tank 114" (FIGS. 5 and 7), thereby forcing air in the space 150 between the bladder 144 and the inside tank wall 148 to flow out, and through the vapor hose 36 into the fuel tank truck 30.

The vapor space of the fuel tanker truck 30 is thus filled with air expelled from the air space 150 about the bladder 144 of the containment tank 114", and the fuel vapor 18 displaced from the ullage space, U, of the underground storage tank 114 is contained with the bladder 144, remaining under control and possession of the service station.

The fuel vapor 18 that remains in the possession of the service station owner within the bladder 144 will subsequently, over time, be drawn back into the ullage space, U, of the underground fuel storage tank 114 as fuel is removed from the tank 114 to fuel customer vehicles, C. The air that would normally be ingested as the gasoline level in the underground storage 114 tank drops is now replaced by fuel vapor 18 from the bladder 144, resulting in essentially no loss of product due to evaporation.

The fuel vapor containment system (12, FIG. 2; 112, FIG. 5) may also provide storage capacity for containing and thereby preventing diurnal breathing losses. These losses occur due to fuel evaporation, as the fuel storage and delivery system (10', FIG. 2, 10" FIG. 5) moves to achieve equilibrium at the interface between liquid fuel 16 and vapor phase fuel 18 in the UST, plus emissions related to barometric pressure changes.

The potential savings that might be realized from use of a vapor containment system of the disclosure at a typical non-Phase II service station are as follows:

Annual value of vapor retained:

Assume:

| | |
|---|---|
| Throughput: | 100,000 gallons of fuel per month |
| Gasoline savings rate: | 0.15% |
| Retail sales price: | $3.00 per gallon |

Annual Savings due to retained vapor $$= 100{,}000 \times 0.0015 \times 3.00 \times 12$$

$$= \$5{,}400 \text{ per year (at 100,000 gallons/month throughput)}$$

-continued

Annual value of vapor retained:

Diurnal breathing loss savings:

Assume:

| | |
|---|---|
| Positive pressure in the UST for 8 hours per day | |
| Vapor Growth Rate: | 0.5 GPM |
| Gasoline evaporated per gallon of vapor: | 3.0 grams |

Given:

| | |
|---|---|
| Gasoline: | 7 pounds per gallon |
| Conversion | 454 grams per pound |

Annual loss:

$$(8\ \text{hrs/day})\cdot(60\ \text{mins/hr})\cdot(0.5\ \text{gpm})\cdot(3\ \text{gms/gal})\sqrt{}\ (454\ \text{gms/lb})\sqrt{}$$

$$(7.0\ \text{lbs/gal})\cdot(365\ \text{days/yr})$$

$$= 82.7\ \text{gallons per year} \times \$3.00\ \text{per gallon}$$

$$= \$248\ \text{per year}$$

Total Savings:

$$= \$5{,}400 + \$248$$

$$= 5{,}648\ \text{per year for each 100,000 gallons of throughput per month}$$

| Annual Throughput | Annual Savings |
|---|---|
| 1,200,000 gallons per year | $5,648 |
| 2,400,000 gallons per year | $11,296 |
| 4,800,000 gallons per year | $22,592 |

Figure 8:
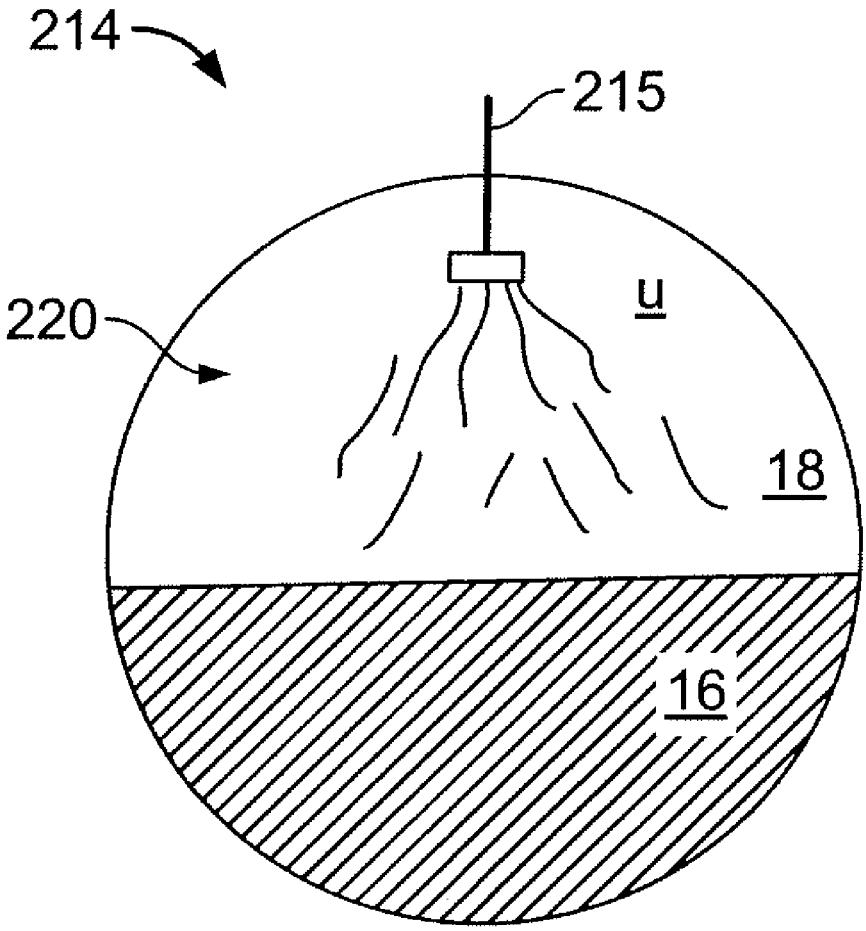
FIG. 8 is an end view of an underground fuel storage tank having a fuel inlet pipe terminating in the ullage space.

Fuel vapor generation and loss can be relatively higher under certain conditions. For example, referring to FIG. 8, in a UST 214, fuel inlet pipe 215 terminates in the upper region of the UST 214, i.e. in the ullage space, U, rather than, as preferred for minimizing fuel vaporization, in the lower region of the UST, preferably below the level of the liquid fuel 16 in UST 214. The fuel spray 220 dropping through the ullage space, U, sharply increases the surface area interface of liquid fuel 16 to air/vapor 18 in the ullage space, U, thus increasing the rate of evaporation of liquid fuel 16 into fuel vapor 18.

A number of implementations of the disclosure have been described. Nevertheless, it will be understood that various modifications may be made without departing from the spirit and scope of the disclosure. For example, the bladder described above may have other forms according to the disclosure. For example, the bladder may alternatively have the form of a resilient wall or a diaphragm.

Referring to FIG. 6, retrofitting of an existing, unused UST 114" is preferred, e.g. as compared to use of an aboveground tank for the vapor control system, including for reasons of cost and security. However, service station USTs are typically protected by a relative thick, reinforced concrete pad 300, making modification of existing below-ground piping difficult and expensive, and thus preferably kept to a minimum. As result, where existing piping arrangements make retrofitting difficult or overly expensive, an aboveground vapor containment system 12, e.g. as described above with reference to FIG. 2, may be more viable.

Also, the submerged turbine pump in a retrofit UST, e.g. UST 114" in FIG. 6, may be removed to allow room for expansion and contraction of the inflatable bladder 144 without unnecessary physical obstruction within the internal volume of the UST.

Figure 7:
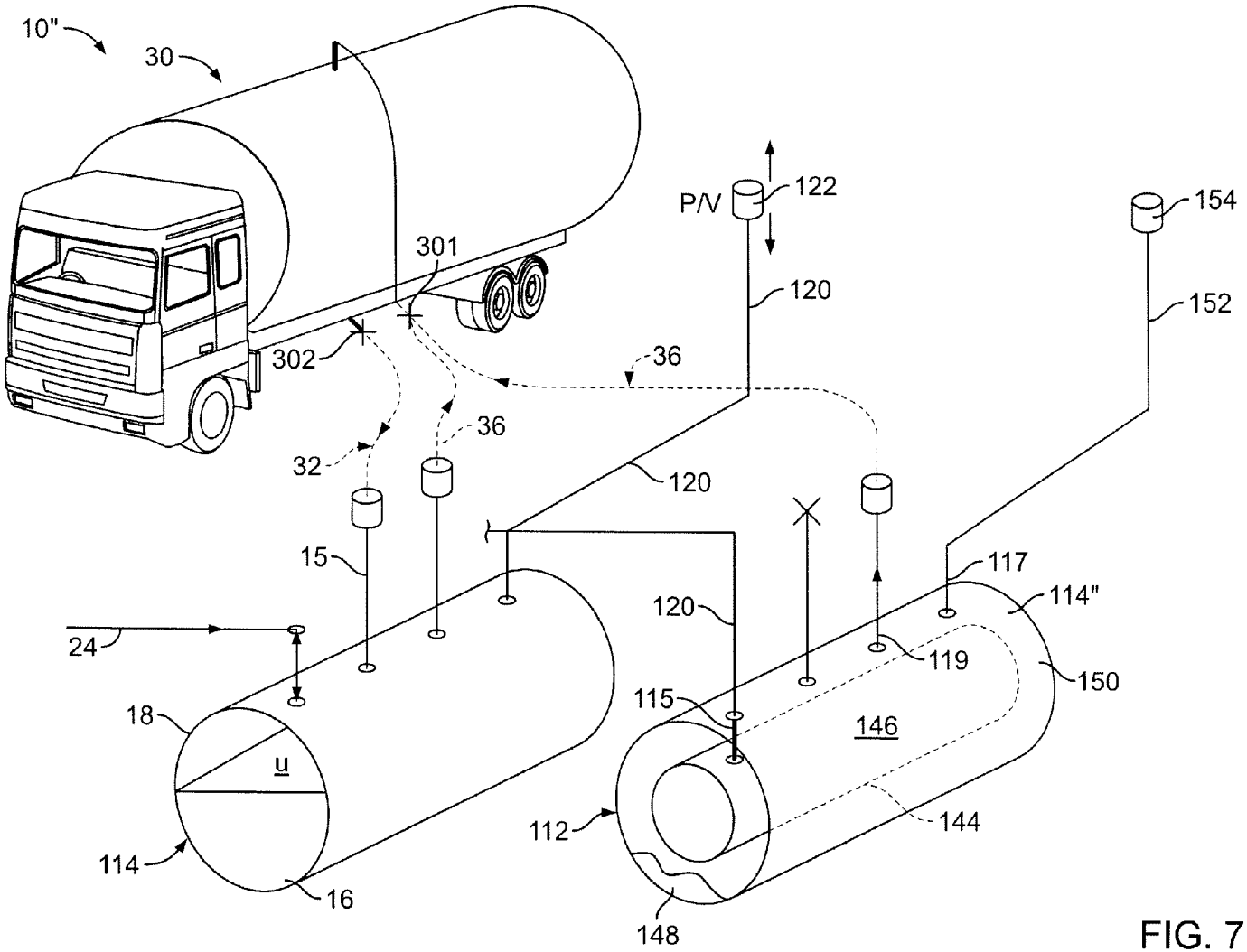
FIG. 7 is a somewhat diagrammatic representation of the fuel vapor containment system of FIG. 5 during a fuel drop.
Figure 9:
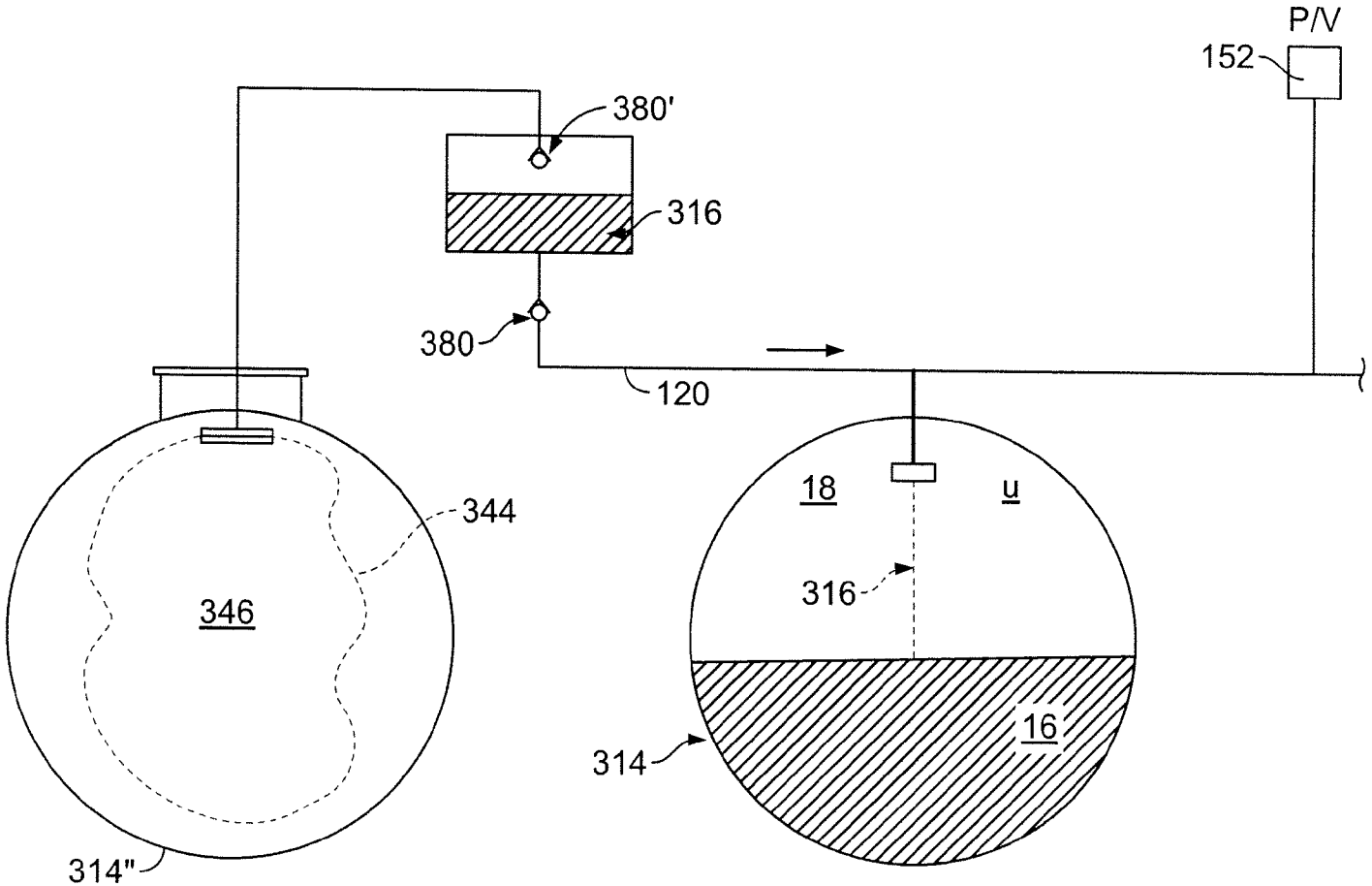
FIG. 9 is an end view of another implementation of a fuel vapor containment system of the disclosure with an underground fuel vapor containment tank.

Additionally referring to FIG. 9, in some implementations, including those described above, in particular with respect to the implementations of FIGS. 5-7, a vapor conduit 120 connecting the ullage space, U, of UST 314 with the volume 346 of the bladder 344 in vapor containment tank 314" may further include float check valve 380, or, in the alternative, float check valve 380', for protecting the volume 346 of the inflatable bladder 344 from liquid fuel 16, e.g. in the event of a tank overfill during a fuel drop. In the alternative arrangement, the positioning of float check valve 380' permits liquid fuel 316 from the truck overfill to drain back into the UST 314.

Accordingly, other implementations are within the scope of the following claims.

What is claimed is:

1. A method of conserving fuel vapor in a liquid fuel dispensing system without fuel vapor recovery or with fuel vapor recovery only during transfer of fuel into fuel storage tanks, the system comprising one or more liquid fuel storage tanks connected to one or more dispensers for delivering liquid fuel to vehicle fuel tanks, said method comprising:

connecting ullage space of the one or more liquid fuel storage tanks to a bladder within a vapor conservation tank;

connecting ullage space of a liquid fuel delivery vehicle to air space of the vapor conservation tank containing the bladder, external of the bladder;

delivering liquid fuel from the liquid fuel delivery vehicle into the one or more liquid fuel Storage tanks, the liquid fuel displacing fuel vapor from the one or more liquid fuel storage tanks;

delivering the fuel vapor displaced from the one or more liquid fuel storage tanks by the liquid fuel into the bladder, the delivered fuel vapor inflating the bladder and displacing air from the air space of the vapor conservation tank external of the bladder;

delivering at least a portion of the air displaced from the air space of the vapor conservation tank into the ullage space of the liquid fuel delivery vehicle, the displaced air replacing a volume of the liquid fuel delivered from the liquid fuel delivery vehicle into the liquid fuel storage tanks; and, thereafter, over time, delivering fuel vapor from the bladder of the vapor conservation tank into the ullage space of the one or more liquid fuel storage tanks, replacing the volume of liquid fuel delivered from the one or more liquid fuel storage tanks into vehicle fuel tanks.

2. The method of claim 1, further comprising:

delivering at least a portion of the air displaced from the air space of the vapor conservation tank into the ambient environment.

3. The method of claim 1, comprising the further step of:

connecting one or more underground storage tanks to a vapor conservation tank in the form of an auxiliary tank containing the bladder.

4. The method of claim 1, comprising the further step of:

connecting one or more underground storage tanks to a vapor conservation tank in the form of an aboveground auxiliary tank containing the bladder.

5. The method of claim 1, comprising the further steps of:

converting an underground storage tank to a vapor conservation tank containing the bladder; and connecting one or more underground storage tanks to the vapor conservation tank in the form of the converted underground storage tank containing the bladder.

6. A fuel vapor conservation system, comprising:

a liquid fuel dispensing system without fuel vapor recovery or with fuel vapor recovery only during transfer of fuel into fuel storage tanks, the system comprising:

one or more liquid fuel storage tanks connected to a liquid fuel dispenser for delivering liquid fuel to vehicle fuel tanks, the one or more fuel storage tanks defining ullage space containing evaporated fuel vapor above an interface with liquid fuel;

a vapor conservation system comprising:

a vapor conservation tank defining a tank volume, and a bladder disposed within the tank volume and defining a bladder volume for receiving fuel vapor, the vapor conservation tank and the bladder defining an air space external of the bladder;

a system of vapor conduit for conducting fuel vapor between the ullage space and the bladder volume; a system of air conduit for conducting air into and out of the air space external of the bladder; and a system of conduit for conducting at least a portion of the air displaced from the air space of the vapor conservation tank by fuel vapor displaced into the bladder volume during delivery of liquid fuel into the fuel storage tanks, and conducting the at least a portion of the air, displaced under pressure from the air space, into the ullage space of a liquid fuel delivery vehicle to replace a volume of liquid fuel delivered from the liquid fuel delivery vehicle into the one or more liquid fuel storage tanks.

7. The fuel vapor conservation system of claim 6, wherein the system of vapor conduit further comprises the system of conduit for:

conducting fuel vapor displaced from the ullage space by addition of liquid fuel to the one or more fuel storage tanks, the displaced fuel vapor being conducted into the bladder volume, and conducting fuel vapor from the bladder volume back into the ullage space as liquid fuel is dispensed from the one or more liquid fuel storage tanks.

8. The fuel vapor conservation system of claim 7, wherein the system of vapor conduit further comprises a float check valve for restricting flow of liquid fuel toward the bladder volume.

9. The fuel vapor conservation system of claim 6, wherein the system of air conduit further comprises a conduit system for delivery of at least a portion of the air displaced from the air space of the vapor conservation tank into the ambient environment.

10. The fuel vapor conservation system of claim 6, wherein the bladder is inflatable and collapsible.

11. The fuel vapor conservation system of claim 6, wherein the bladder is formed of thin wall, flexible material.

12. The fuel vapor conservation system of claim 11, wherein the bladder is formed of resilient material.

* * * * *